United States Patent [19]

Bleys

[11] 4,443,003

[45] Apr. 17, 1984

[54] BLOWTORCH CUTTING HEAD, PARTICULARLY FOR OXYGEN CUTTING

[75] Inventor: Christian Bleys, Livry, France

[73] Assignee: L. Sauvageau & Cie, Ozoir la Ferriere, France

[21] Appl. No.: 419,339

[22] Filed: Sep. 17, 1982

[30] Foreign Application Priority Data

Sep. 18, 1981 [FR] France ..... 81 17641

[51] Int. Cl.[3] ..... B23K 7/00

[52] U.S. Cl. ..... 266/48; 266/77

[58] Field of Search ..... 266/48, 77

[56] References Cited

U.S. PATENT DOCUMENTS

| | | | |
|---|---|---|---|
| 3,299,939 | 1/1967 | Marra, Sr. | 266/48 |
| 3,389,861 | 6/1968 | Nakanishi et al. | 266/48 |
| 4,171,124 | 10/1979 | Coulter et al. | 266/77 |

*Primary Examiner*—W. Stallard

*Attorney, Agent, or Firm*—Pollock, Vande Sande & Priddy

[57] ABSTRACT

Cutting head usable equally well with "head mixed" blowtorches (1) as with "premixed" ones, comprising a male part (6) and a female part (7), and characterized in that:

(a) the end of the male part in contact with the blowtorch has a flange (20) the diameter of which is less than that of the chamber (5) into which open conduits (3 and 4) for the heating oxygen and gas of a "head mixed" torch, or the conduit for the heating mixture of a "premixed" torch, and which is crossed by at least two diametrically opposed holes (21);

(b) between the male part and the female part is provided an annular passage (22) for the heating oxygen/gas mixture; and (c) in communication with the holes (21) are hollows (21*a*) provided in the lower protruding part of the flange, or assemblies provided in the female part, which make possible the aspiration of gas, said hollows or assemblies being in communication with the annular passage (22).

4 Claims, 11 Drawing Figures

BLOWTORCH CUTTING HEAD, PARTICULARLY FOR OXYGEN CUTTING

Various cutting heads exist for oxygen cutting blowtorches.

Some are designed to operate on "premixing" torches, meaning that the gas mixture is made in a mixing system located above the head.

Others are meant to operate on "head mixed" torches. As the name implies, the gas mixture is made in the head, and in this case the injector/mixer system above the head is no longer needed.

The present invention concerns improvements in existing heads for "premixed" torches, so as to enable them to operate equally well on "head mixed" torches.

The invention is specifically designed to improve heads comprising a male part, or inner nozzle, and a female part, or outer nozzle.

Two sample embodiments of the invention will now be described with reference to the attached drawings, in which.

Figure 1:
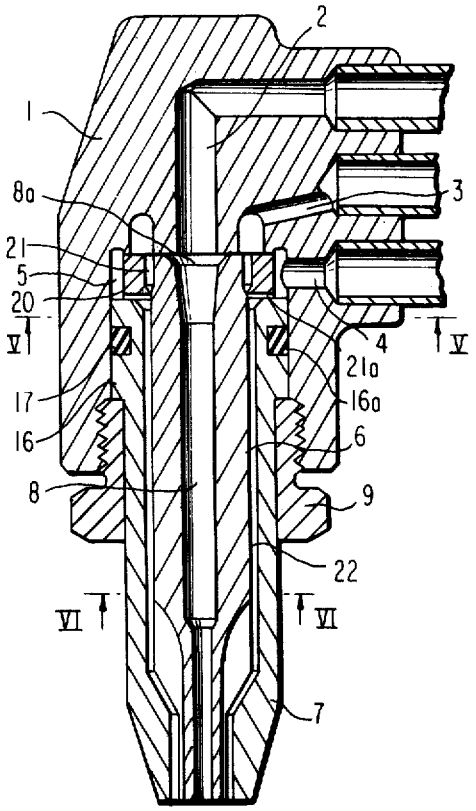
FIG. 1 is a longitudinal cross-section of a head according to the teachings of the invention, joined to the head-holder of a "head mixed" torch.

FIG. 1 shows a cutting head under the invention, joined to the head-holder of a "head mixed" blowtorch. Head-holder 1 of the torch has a bored conduit 2 for the cutting oxygen, a conduit 3 for the heating oxygen, and a conduit 4 for the combustible gas. These three conduits open into a chamber 5 into which may be introduced an inner nozzle 6 and outer nozzle 7 which work together to form the cutting head of the invention. These nozzles will be described below, but it will be indicated immediately that nozzle 6 has an axial bore 8 aligned with conduit 2 of head-holder 1, the upper end of which bore has a truncated shape **8*a* whose role will be explained further on, and that a coupling 9 screwed into chamber 5 of head-holder 1 ensures the retention and correct positioning of outer nozzle 7**.

Figure 2:
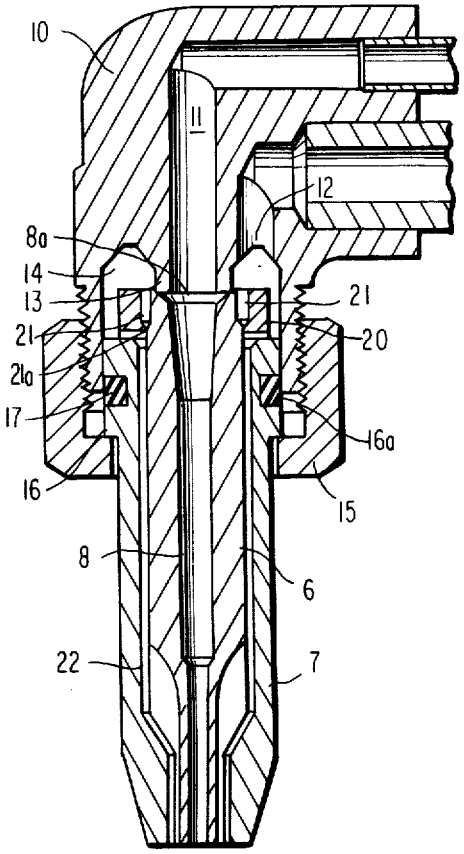
FIG. 2 is a cross-section analogous to FIG. 1 but showing a head according to the teachings of the invention joined to the head-holder of a "premixed" torch.

FIG. 2 shows the cutting head of the invention, to be described hereinafter with reference to FIGS. 3 and 4, joined to the head-holder 10 of a "premixing" torch. This cutting head has a bored conduit 11 for the cutting oxygen and a conduit 12 for the heating mixture. The lower section of head-holder 10 has an axial protrusion 13 containing the end of conduit 11 and located in chamber 14, into the top of which opens conduit 12 and into which the abovementioned nozzles 6 and 7 may be introduced. A coupling 15 screwed over head-holder 10 ensures the retention and correct positioning of outer nozzle 7. Bore 8 of nozzle 6 of the invention is aligned with conduit 11 for the cutting oxygen, and its upper, truncated end **8*a* enables protrusion 13 of head-holder 10** to be received, thereby maintaining separation between the cutting oxygen and the heating mixture.

The make-up of nozzles 6 and 7, their assembly, and their connection with chamber 5 or 14 will now be described in greater detail.

The upper end of outer nozzle 7 (FIGS. 1 and 2) has a flange 16 equipped with a throat groove **16*a* which receives a toroid gasket providing a seal with respect to the outside, while the seal between conduits 2 and 4 or 11 and 12 is provided by metal-against-metal contact, flat in the case of FIG. 1 and between a sphere and cone 8*a* in the case of FIG. 2**.

Figure 3:
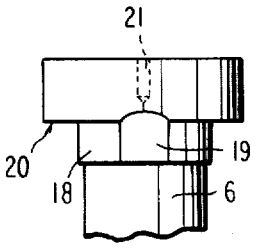
FIG. 3 is an external view of a portion of the inner nozzle.
Figure 4:
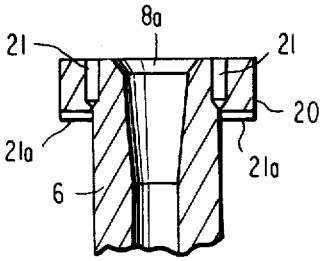
FIG. 4 is a partial cross-section of this nozzle in a plane perpendicular to that of FIG. 3.
Figure 5:
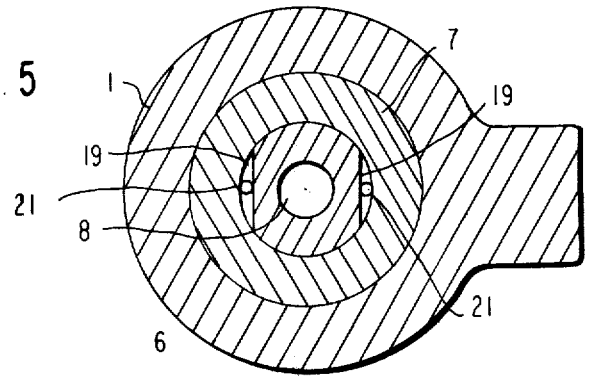
FIGS. 5 and 6 are cross-sections through lines V—V and VI—VI respectively of FIG. 1.
Figure 6:
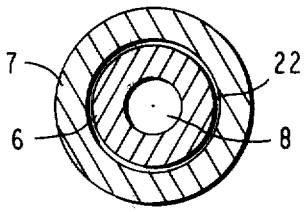
Figure 7:
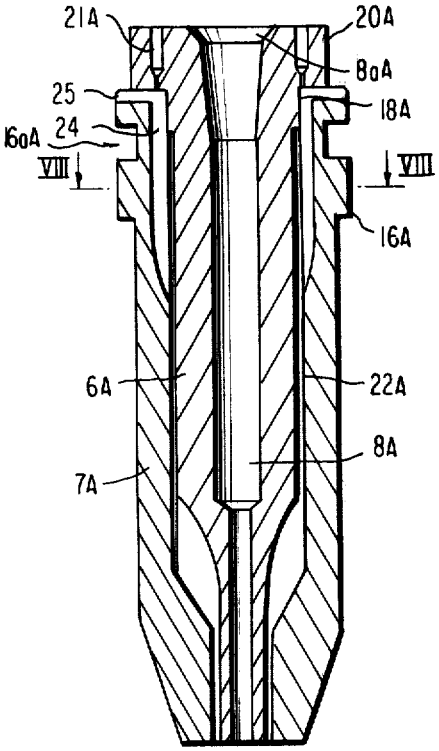
FIG. 7 is a cross-section analogous to FIGS. 1 and 2 but showing a second embodiment of the nozzle of the invention, with the head-holder.
Figure 9:
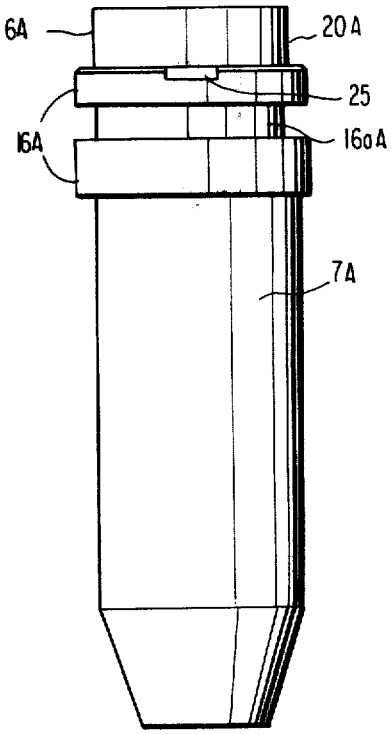
FIG. 9 is an external view of the set of nozzles of FIG. 7.
Figure 8:
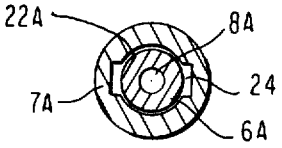
FIG. 8 is a cross-section through line VIII—VIII of FIG. 7.
Figure 10:
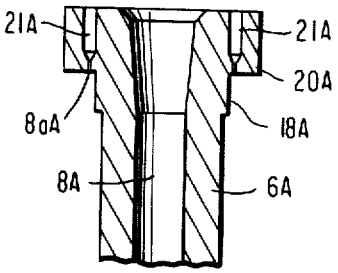
FIG. 10 is a partial cross-section of the inner nozzle.
Figure 11:
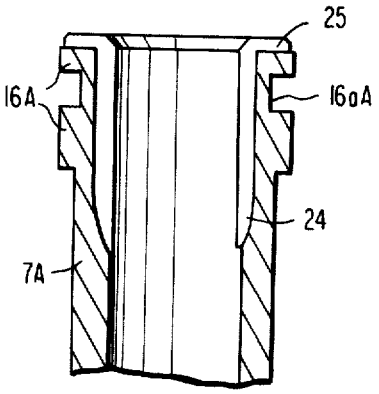
FIG. 11 is a partial cross-section of the outer nozzle, which together form the cutting head of FIG. 7.

FIGS. 3 and 4 reveal the shape of inner nozzle 6. This nozzle comprises a flange 20 which separates the gasses as described above and positions the inner nozzle longitudinally within the outer nozzle. It also comprises a flange 18 (FIG. 3) which centers nozzle 6 within nozzle 7. On the flange, two opposing flat surfaces 19 formed by milling engage flange 20 and form hollows **21*a* (FIGS. 1, 2, and 4). Two opposing holes 21 pierced in the axis of each flat area 19 allow for the passage of oxygen coming from conduit 3 (FIG. 1) and of the mixture coming from conduit 12 (FIG. 2), and communicate with aforementioned hollows 21*a* provided in the lower protruding part of flange 20, which makes possible, in the case of FIG. 1, the aspiration of combustible gas and the mixing of the gasses, which are then sent into annular space 22 (FIGS. 1, 2, and 6) between nozzles 6 and 7**.

In the variant of FIGS. 7 through 11, a second embodiment of the invention can be seen. In these figures, the parts corresponding to those of FIGS. 1 through 6 are designated by the same numerals, followed by the letter A.

The end of inner male nozzle 6A in contact with head-holder 1 or 10 of the blowtorch (not shown in FIGS. 7 and 9) has a flange 20A the diameter of which is the same as that of flange 20 of FIGS. 1 through 4 and which is also pierced with two opposing holes 21A. Nozzle 6A likewise has a central bore 8A identical to bore 8 of FIGS. 1, 2, 4–6, and the upper end of bore 8A also has a truncated shape **8*a*A. Below flange 20A lies another flange 18A the role of which will be explained below. The upper end of outer female nozzle 7A for its part possesses a flange 16A equipped with a throat groove 16*a*A intended to receive a toroid gasket (not shown) like gasket 17 of FIGS. 1 and 2. It further possesses two hollows 24 at the upper ends of which are provided passages 25 (FIGS. 7, 9, and 11) perpendicular to hollows 24, through which can be established a connection between conduit 4 of FIG. 1 or conduit 12 of FIG. 2 and annular passage 22A separating nozzles 6A and 7A. Above-mentioned flange 18A makes possible a tight and definitive fitting of nozzles 6A and 7A, and provides for the correct orientation of passages 25 with respect to holes 21A**, in the case of both a "head mixed" blowtorch or a "premixed" one.

It will be emphasized that in contrast to the embodiment of FIGS. 1 through 6, the variant of FIGS. 7 through 11 requires precise alignment of passages 25 with heating oxygen injection holes 21A, a requirement that prevents this embodiment from being disassembled.

It is understood that the embodiments described and represented have been provided solely as examples and might undergo numerous modifications without thereby departing from the scope of the invention. In particular, the principle of the invention is equally applicable to soldering or heating torches. It is enough to eliminate axial bore 8 or 8A for the cutting oxygen located in the center of inner nozzle 6 or 6A.

The invention has numerous advantages over existing systems:

(a) The head is polyvalent, since it can be mounted on blowtorches of different designs (premixed or head mixed);

(b) Though polyvalent, the head makes possible the aspiration of combustible gas in the case of FIG. 1, which makes for additional safety.

(c) Construction is simple and economical;

(d) The head can be disassembled, since nozzles 6 and 7 are free mounted, making for easy cleaning. (Note: Some variants may not be disassemblable.)

I claim:

1. Blowtorch cutting head, particularly for oxygen cutting, usable equally well with "head mixed" torches (1 or 10) and "premixing" torches (10), comprising a male part (6 or 6A) and a female part (7 or 7A), and characterized in that:

(a) the end of the male part in contact with the torch (1 or 10) has a flange (20 or 20A) the diameter of which is less than that of the chamber (5 or 14) into which open either the conduits (3 and 4) for the heating oxygen and gas for a "head mixed" torch, or the conduit (12) for oxygen/gas mixture of a "premixed" torch, and which is traversed by at least two diametrically opposed holes (21 or 21A);

(b) between the male part (6 or 6A) and the female part (7 or 7A) is provided an annular passage (22 or 22A) for the heating oxygen/gas mixture; and (c) in communication with the holes (21 or 21A) are either hollows (**21*a*) provided in the lower protruding portion of the flange (20) or assemblies (24, 25) provided in the female part (7A), with said hollows (21*a*) or assemblies (24, 25) communicating with the annular passage (22 or 22A**).

2. Cutting head of claim 1, characterized in that:

(a) the male part, or inner nozzle (6), has a slight cylindrical protrusion (18) serving to center it within the female part, or outer nozzle (7), while leaving said annular passage (22) between said nozzles for the heating oxygen/gas mixture;

(b) two opposing flat surfaces (19) are milled onto this protrusion and engage a section of said flange (20); and (c) said diametrically opposed holes (21) are provided within the axis of each flat surface (19) and correspond with said hollows (**21*a***), enabling the aspiration of the gas.

3. Cutting head of claim 1, characterized in that:

(a) the female part, or outer nozzle (7A), has a flange (16A) the free end of which is provided with two hollows (25) parallel to its upper surface for the intake of combustible gas, followed by two hollows (24) perpendicular to the first and communicating with the annular passage (22A) which separates the outer nozzle (7A) from the inner nozzle (6A) and through which the heating mixture flows;

(b) the male part, or inner nozzle (6A), has a flange (20A) into which are bored said diametrically opposed holes (21A) located opposite said hollows (25) and enabling combustible gas to be breathed in, or aspirated.

4. Cutting head according to any of claims 1 through 3, usable with soldering or heating torch, and characterized in that the male part (6 or 6A) does not comprise an axial bore (8, 8A).

* * * * *